US009079444B2

(12) United States Patent
Stork et al.

(10) Patent No.: US 9,079,444 B2
(45) Date of Patent: Jul. 14, 2015

(54) METHOD FOR PRODUCING A HEAT-SENSITIVE RECORDING MATERIAL

(75) Inventors: Gerhard Stork, Flensburg (DE); Matthias Marx, Nortorf (DE); Falk Jahns, Flensburg (DE)

(73) Assignee: Mitsubishi HiTech Paper Europe GmbH, Bielefeld (DE)

( * ) Notice: Subject to any disclaimer, the term of this patent is extended or adjusted under 35 U.S.C. 154(b) by 0 days.

(21) Appl. No.: 13/984,869

(22) PCT Filed: Feb. 8, 2012

(86) PCT No.: PCT/EP2012/052151
§ 371 (c)(1), (2), (4) Date: Nov. 13, 2013

(87) PCT Pub. No.: WO2012/107504
PCT Pub. Date: Aug. 16, 2012

(65) Prior Publication Data

US 2014/0057783 A1 Feb. 27, 2014

(30) Foreign Application Priority Data

Feb. 11, 2011 (EP) ..... 11154121

(51) Int. Cl.

| | |
|---|---|
| ***B41M 5/327*** | (2006.01) |
| ***B41M 5/333*** | (2006.01) |
| ***B41M 5/40*** | (2006.01) |
| ***B41M 5/44*** | (2006.01) |
| ***B41M 5/337*** | (2006.01) |

(52) U.S. Cl.
CPC ..... *B41M 5/3336* (2013.01); *B41M 5/3275* (2013.01); *B41M 5/3372* (2013.01); *B41M 5/3375* (2013.01); *B41M 5/405* (2013.01); *B41M 5/44* (2013.01); *B41M 2205/34* (2013.01); *B41M 2205/36* (2013.01); *B41M 2205/38* (2013.01); *B41M 2205/40* (2013.01)

(58) Field of Classification Search
CPC .. B41M 5/3275; B41M 5/3336; B41M 5/405; B41M 5/44; B41M 2205/34; B41M 2205/36; B41M 2205/38; B41M 2205/40; B41M 5/327; B41M 5/333; B41M 5/40
USPC ..... 503/200, 217, 219, 226; 427/151, 152
See application file for complete search history.

(56) References Cited

U.S. PATENT DOCUMENTS

| | | | | |
|---|---|---|---|---|
| 6,103,661 | A * | 8/2000 | Fujii et al. | 503/201 |
| 7,501,381 | B2 * | 3/2009 | Kutami et al. | 503/201 |
| 8,143,191 | B2 | 3/2012 | Aihara | |

FOREIGN PATENT DOCUMENTS

| | | |
|---|---|---|
| EP | 2112000 | 1/2011 |
| EP | 2103444 | 5/2012 |

* cited by examiner

*Primary Examiner* — Bruce H Hess
(74) *Attorney, Agent, or Firm* — Cozen O'Connor

(57) ABSTRACT

A method for producing a heat-sensitive recording material comprises: preparing a first coating composition, which includes as color acceptor 4,4'-dihydroxydiphenyl sulfone, at least one sensitizer selected from the list of methylolstearamide, stearic acid amide, and dimethyl terephtalate; preparing a second coating composition, which includes: from 65 to 95% by weight of one or more (meth)acrylate from 0 to 20% by weight of photoinitiators and from 0.5 to 20% by weight of wax; applying the prepared first coating composition to form the heat-sensitive recording layer on the front side of the substrate; drying the first coating composition; applying the second coating composition to form the protective layer covering the heat-sensitive recording layer; crosslinking the protective layer covering the heat-sensitive recording layer; applying the second coating composition to form the coating on the back side of the substrate; crosslinking the coating.

16 Claims, No Drawings

METHOD FOR PRODUCING A HEAT-SENSITIVE RECORDING MATERIAL

PRIORITY CLAIM

This is a U.S. national stage of application No. PCT/EP2012/052151, filed on Feb. 8, 2012. Priority is claimed on the following application(s): Country: EP, Application No.: 11154121.5, filed: Feb. 11, 2011, the content of which is/are incorporated herein by reference in its entirety.

FIELD OF THE INVENTION

The present document is directed to a method for producing a heat-sensitive recording material with a substrate having a front side and a back side located opposite to the front side, with a heat-sensitive recording layer which is arranged on the front side of the substrate and contains color formers and color acceptors, with a protective layer covering this heat-sensitive recording layer, and with a coating arranged on the back side of the substrate.

BACKGROUND OF THE INVENTION

A method of the type mentioned above is known, for example, from EP 1 684 989 B1 which is characterized particularly in that the heat-sensitive recording layer is coated on and the protective layer which covers this heat-sensitive recording layer is printed on, both within one machine pass. The cited document is important inasmuch as it combines printing and coating methods for producing a heat-sensitive recording material such as practiced on a coating machine or even on a paper machine. Unfortunately, the cited document does not contain any further suggestions for forming the heat-sensitive recording layer or for forming the protective layer covering this heat-sensitive recording layer.

EP 2 112 000 A1 suggests a heat-sensitive recording material in which a heat-sensitive recording layer and, optionally, a protective layer covering this recording layer is provided on the one side of a substrate and an optional backcoat is provided on the other side of the substrate. According to this known document, a particularly stable, counterfeit-proof print image formed by supplying heat is achieved through the combination of N-(p-toluenesulphonyl)-N'-3-(p-toluenesulphonyloxyphenyl)urea as color acceptor of a leuco dye system on the one hand and, on the other hand, an imino component which forms an anti-fade system in conjunction with the isocyanate component. This document does not address the possible problem of jamming and sticking together due to the effect of moisture.

EP 2 103 444 A1 discloses a heat-sensitive recording material with a particularly soft, high-gloss film which, comprises polypropylene as substrate and on which a heat-sensitive recording layer and a protective layer are applied on one side and a backcoat is applied on the other side. The backcoat is characterized in that it comprises a special acrylic resin or a special copolymer polyester resin, a hydrazine derivative with a hydrazine residual group, and a quaternary ammonium polymer.

Heat-sensitive recording materials of the general type have been known for many years and are steadily gaining in popularity. This may be explained inter alia by the fact that their use as tickets in particular offers great advantages to ticket suppliers. Because the color-forming components in the heat-sensitive recording process reside in the recording material itself, it is possible to employ large numbers of thermal printers which operate without toner or ink cartridges and whose function need no longer be monitored by persons at regular intervals. Accordingly, this innovative technology has had extensive success particularly in public transportation, busses and rail transportation, air travel, stadium and museum ticket kiosks, and parking receipt dispensers. However, it is precisely in this very important area of application of parking receipts that numerous problems persist which have not so far been solved in a convincing manner.

Owing to the fact that parking receipt tickets may be exposed to direct sunlight at very high temperatures when placed behind the windshield, as is frequently required, it happens time and again that the heat-sensitive ticket darkens heavily to the point of turning completely black. The print image produced by the thermal printer is then no longer legible, and the tickets become unusable while still within their period of validity. Poor resistance of the heat-sensitive recording material used for the parking receipt tickets to grease and plasticizers further impairs the legibility of the printed information. However, parking receipt tickets very often come into contact precisely with these substances because grease often adheres to the fingers and hands of the user, and plasticizers are contained in sleeves into which the parking receipt tickets are inserted during their period of use.

Another problem is the risk of jamming of ticket rolls after coming into contact with water. For example, when rolls or fan-folded stacks of parking receipt tickets of heat-sensitive recording material to be dispensed are loaded in automatic ticket dispensers in rainy weather, it may happen that these rolls or fan-folded stacks are dampened by raindrops and this moisture penetrates into the ticket rolls or fan-folded stacks. If the constituents particularly in the outer layers of the parking receipt tickets begin to dissolve, the individual layers within a roll or within the fan-folded stack of parking receipt tickets to be dispensed may stick together resulting in a total breakdown of the automatic ticket dispenser in question. Dust is another problem which arises when heat-sensitive recording material is formed in fan-folded stacks. In particular, heat-sensitive recording materials with highly water-resistant protective layers are often very brittle so that the protective layers can flake off at the cut edges and folded edges. This causes dust and disrupts production.

The problems described above relating to severe background darkening due to direct sunlight, or jamming and sticking together due to the effect of moisture, are even more pronounced in the case of parking tickets which are placed under the windshield wipers of illegally parked cars because they are even more exposed to environmental influences.

SUMMARY OF THE INVENTION

In view of the above, the problem consists in making use of the insights gained from the methods known from EP 1 684 989 and optimizing and modifying them in such a way that a heat-sensitive recording material provided for trouble-free use as parking receipts and parking tickets can be produced in a high-quality yet economical process which nevertheless guarantees reasonable production costs.

The solution to this challenging problem is provided by a method for producing a heat-sensitive recording material

- with a substrate having a front side and a back side located opposite to the front side,
- with a heat-sensitive recording layer which is disposed on the front side of the substrate and contains color formers and color acceptors,
- with a protective layer covering this heat-sensitive recording layer, and with a coating arranged on the back side of the substrate, wherein the method comprises at least the following method steps:

preparing a first coating composition, wherein this first coating composition at least comprises:

as color acceptor at least 85% by weight of 4,4'-dihydroxydiphenyl sulfone based on the total percentage of color acceptors in the first coating composition, at least one sensitizer selected from the list comprising methylolstearamide, stearic acid amide, and dimethyl terephtalate, preparing a second coating composition, wherein this second coating composition at least comprises:

from 65 to 95% by weight of one or more (meth)acrylates selected from the group comprising polyether (meth)acrylate, epoxy(meth)acrylate and urethane (meth)acrylate, from 0 to 20% by weight of photoinitiators and from 0.5 to 20% by weight of wax, wherein the indicated weight percent adds up to from 65.5 to 100% by weight of the second coating composition, continuously supplying the web-shaped substrate, applying the prepared first coating composition to form the heat-sensitive recording layer arranged on the front side of the substrate, drying the first coating composition, applying the prepared second coating composition to form the protective layer covering the heat-sensitive recording layer, crosslinking the protective layer covering the heat-sensitive recording layer by means of high-energy radiation, applying the prepared second coating composition to form the coating arranged on the back side of the substrate, crosslinking the coating arranged on the back side of the substrate by means of high-energy radiation.

The disclosed method first provides for preparing a first coating composition, for which purpose the use of receptacle scales is especially advisable for precise supplying and metering of bulk components and liquid components.

The first coating composition which is provided for forming the heat-sensitive recording layer comprises as color acceptor at least 85% by weight of 4,4'-dihydroxydiphenyl sulfone based on the total percentage of color acceptors in the first coating composition. 4,4'-Dihydroxydiphenyl sulfone is also commonly called 4,4'-sulfonylbisphenol and is also known under the trade name 4,4 Bisphenol S. 4,4'-Dihydroxydiphenyl sulfone has the chemical formula $C_{12}H_{10}O_4S$ and can be represented by the following formula (1):

Formula 1

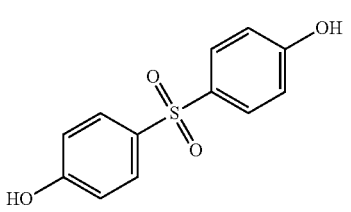

The use of 4,4'-dihydroxydiphenyl sulfone as color acceptor is known, for example, from EP 2 279 877 A1 which also discloses the combination of 4,4'-dihydroxydiphenyl sulfone with a sensitizer such as methylolstearamide, stearic acid amide, and dimethyl terephtalate, for example. Unfortunately, however, the above-cited document fails to suggest a method by which a protective layer or even a (meth)acrylate-based backcoat is applied and subsequently crosslinked.

In addition to 4,4'-dihydroxydiphenyl sulfone, the first coating composition in the present invention can have additional color acceptors selected from the list comprising:

2,2-bis(4-hydroxyphenyl)propan—also known as Bisphenol A,

4-[(4-(1-methylethoxy)phenyl)sulfonyl]phenol—also known as D8

N-(p-toluenesulphonyl)-N'-3-(p-toluenesulphonyloxyphenyl)urea—also known as Pergafast® 201.

In a preferred embodiment, a maximum of 8.5% by weight of the above-mentioned color acceptors—based on the total content of color acceptors in the first coating composition—are incorporated individually or in combination in this first coating composition, with 4,4'-dihydroxydiphenyl sulfone accounting for the remainder. Finally, in a particularly preferred embodiment, 4,4'-dihydroxydiphenyl sulfone is the only color acceptor in the first coating composition.

As color formers in the first coating composition, the heat-sensitive recording material preferably has those selected from the list comprising:

3-diethylamino-6-methyl-7-anilinofluoran, 3-dibutylamino-6-methyl-7-anilinofluoran, 3-(N-methyl-N-propyl)amino-6-methyl-7-anilinofluoran, 3-(N-ethyl-N-isoamyl)amino-6-methyl-7-anilinofluoran, 3-(N-methyl-N-cyclohexyl)amino-6-methyl-7-anilinofluoran, 3-(N-ethyl-N-tolyl)amino-6-methyl-7-anilinofluoran, and 3-(N-ethyl-N-tetrahydrofuryl)amino-6-methyl-7-anilinofluoran. In this connection, 3-dibutylamino-6-methyl-7-anilinofluoran—also known as ODB-2—is particularly preferred.

The first coating composition may have more than one color former selected from the color formers listed above.

In addition to or as an alternative to the substances specified as color formers in the paragraph above, the method according to the invention for producing a heat-sensitive recording material can also contain within the first coating composition one or more of the following compounds which are absorbent in the near infrared range:

3,6-Bis(dimethylamino)fluorene-9-spiro-3'-(6'-dimethylaminophthalide), 3-diethylamino-6-dimethylaminofluorene-9-spiro-3'-(6'-dimethylaminophthalide), 3,6-bis(diethylamino)-fluorene-9-spiro-3'-(6'-dimethylaminophthalide), 3-dibutylamino-6-dimethylaminofluorene-9-spiro-3'-(6'-dimethylaminophthalide), 3-dibutylamino-6-diethylaminofluorene-9-spiro-3'-(6'-dimethylaminophthalide), 3,6-bis(dimethylamino)fluorene-9-spiro-3'-(6'-diethylaminophthalide), 3-diethylamino-6-dimethylaminofluorene-9-spiro-3'-(6'-diethylaminophthalide), 3-dibutylamino-6-dimethylaminofluorene-9-spiro-3'-(6'-diethylaminophthalide), 3,6-bis-(di-ethylamino)fluorene-9-spiro-3'-(6'-diethylaminophthalide), 3,6-bis-(dimethylamino)-fluorene-9-spiro-3'-(6'-dibutylaminophthalide), 3-dibutylamino-6-diethylaminofluorene-9-spiro-3'-(6'-diethylaminophthalide), 3-diethylamino-6-dimethylaminofluorene-9-spiro-3'-(6'-dibutylaminophthalide), 3,3-bis[2-(4-dimethylamino-phenyl)-2-(4-methoxyphenyl)-ethenyl]-4,5,6,7-tetrachlorophthalide.

For increased thermal responsiveness, the first coating composition contains at least one sensitizer selected from the list comprising methylolstearamide, stearic acid amide and dimethyl terephtalate which are used alone, i.e., not combined with the two other above-mentioned sensitizers from the above list, without such combination being excluded within the scope of the present invention. Of the three sensitizers mentioned above, dimethyl terephtalate is particularly preferred.

The sensitizers mentioned above can also be used in the first coating composition possibly in combination with the following products: benzyl-p-benzyloxy-benzoate, p-benzylbiphenyl, 1,2-di(phenoxy)-ethane, 1,2-di(m-methylphenoxy)ethane, m-terphenyl, dibenzyloxalate, benzyl naphthyl ether and diphenyl sulfone.

It has been shown in numerous tests that a ratio of color acceptor$_{total}$:sensitizer$_{total}$ and particularly 4,4'-dihydroxydiphenyl sulfone:sensitizer selected from the list comprising methylolstearamide, stearic acid amide, and dimethyl terephtalate based on percent by weight in the first coating composition is preferably in a range of from 1:0.5 to 1:2 and particularly preferably in a range of from 1:0.8 to 1:1.4.

Suitable binders for incorporating in the first coating composition are, for example, water-soluble binders such as starch, hydroxy ethyl cellulose, methyl cellulose, carboxy methyl cellulose, gelatins, casein, polyvinyl alcohols, modified polyvinyl alcohols, ethylene vinyl alcohol copolymers, sodium polyacrylates, acrylamide/acrylate copolymers, acrylamide/acrylate/methacrylate terpolymers and alkali salts of styrene maleic acid anhydride copolymers or ethylene maleic acid anhydride copolymers, wherein the binders can be used alone or in combination with one another; also, water-insoluble latex binders such as styrene-butadiene copolymers, acryl nitrile butadiene copolymers, and methyl acrylate butadiene copolymers can be used as binders for incorporation in the first coating composition. Within the meaning of the present invention, polyvinyl alcohol, ethylene vinyl alcohol copolymers, or polyvinyl alcohol in combination with ethylene vinyl alcohol copolymers are particularly preferred binders and are together incorporated in the first coating composition in a range of from 10 to 20% by weight based on the total weight of the first coating composition.

To prevent sticking to a thermal head and to prevent excessive wear of the thermal head, the first coating composition for forming the heat-sensitive recording layer can also contain lubricants and release agents such as metal salts of higher fatty acids, for example, zinc stearate, calcium stearate, and waxes such as, e.g., paraffin, oxidized paraffin, polyethylene, polyethylene oxide, stearic acid amide, and castor wax. Other possible constituents of the first coating composition are, for example, pigments, preferably inorganic pigments such as, for example, aluminum (hydr)oxide, silicic acid, and calcium carbonate. Calcium carbonate which is preferably incorporated in the first coating composition in a quantity from 0 to 28% by weight is particularly preferred.

The present method further provides for preparing a second coating composition.

The second, non-aqueous coating composition comprises at least from 65 to 95% by weight of one or more (meth)acrylates selected from the group comprising polyether(meth) acrylate, epoxy(meth)acrylate and urethane(meth)acrylate.

Examples of the (meth)acrylates according to the second coating composition for the protective layer are dipentaerythritol penta(meth)acrylate and are found, for example, in U.S. Pat. No. 4,485,123 and EP 0 209 684 A1. At least one (meth)acrylate of the above-mentioned group is preferably an amine modified (meth)acrylate. Amine modified polyether acrylate is preferably used as amine modified (meth)acrylate. The second coating composition is preferably virtually free from monomers or reactive thinners and has a low residual content of (meth)acrylic acid.

from 0 to 20% by weight of photoinitiators.

Photoinitiators that can be used are those that initiate curing and radial polymerization using high-energy radiation, preferably UV radiation, and absorb, for example, in the wavelength from 190 to 400 nm. Photoinitiators of this type include, for example, chlorine-containing photoinitiators, aromatic ketones, hydroxyalkyl phenones and phosphine oxides. Benzophenone derivatives, phenyl ketones and phenyol phosphenates are preferred photoinitiators.

from 0.5 to 20% by weight of wax.

Polyethylene waxes such as PTFE-modified polyethylene wax are examples of waxes that can be used.

A coating composition of this type is known, for example, from EP 1 663 662 B1. Unfortunately, however, this document does not suggest a method comprising as essential aspect a use of this coating composition on the one hand as a protective layer over a heat-sensitive recording layer containing 4,4'-dihydroxydiphenyl sulfone and, on the other hand, as a backcoat.

The present method further provides within the framework of a preferred embodiment the preparation of a third coating composition. The third coating composition comprises particularly preferred organic pigments and inorganic pigments. The inorganic pigments, individually or in combination with one another, are selected from the list comprising calcined kaolin, silicon oxide, bentonite, calcium carbonate and aluminum oxide, in this case in particular, boehmite.

The quantitative ratio of organic to inorganic pigment represents a compromise in the effects achieved by the two types of pigment which is resolved in a particularly advantageous manner when from 5 to 30% by weight, or preferably from 8 to 20% by weight of the pigment mixture consists of organic pigment and from 95 to 70% by weight , preferably from 92 to 80% by weight, of inorganic pigment. Pigment mixtures of different organic pigments are possible.

In addition to the inorganic pigments and, as the case may be, organic pigments, the third coating composition contains at least one binder which is preferably based on a synthetic polymer. For example, styrene-butadiene latex delivers especially good results. In a particularly suitable embodiment, a synthetic binder is used with the addition of at least one natural polymer, particularly preferably starch. Further, it was determined in tests with inorganic pigments that a particularly suitable embodiment is achieved with a binder-to-pigment ratio in the third coating composition of between 3:7 and 1:9 with respect to percent by weight.

Within the framework of a particularly preferred embodiment, the sequence of at least the following method steps can be carried out in exactly one pass through exactly one machine; a machine of this kind can be a paper machine with integrated coaters and printing units:

(i) continuously supplying the web-shaped substrate, (ii) optionally applying the prepared third coating composition to form the pigmented intermediate layer on the front side of the substrate, (iii) optionally drying the third coating composition, (iv) optionally smoothing the substrate with the applied, dried third coating composition, (v) applying the prepared first coating composition to form the heat-sensitive recording layer arranged on the front side of the substrate, (vi) drying the first coating composition, (vii) optionally smoothing the substrate with the optionally applied, dried third coating composition and the applied, dried first coating composition, (viii) applying the prepared second coating composition to form the protective layer covering the heat-sensitive recording layer, (ix) crosslinking the protective layer covering the heat-sensitive recording layer by means of high-energy radiation, (x) applying the prepared second coating composition to form the coating arranged on the back side of the substrate, (xi) crosslinking the coating arranged on the back side of the substrate by means of high-energy radiation.

As an alternative to the particularly preferred embodiment in the preceding paragraph, two machines can be used within the framework of an equally preferred embodiment for implementing the above-mentioned method steps (i) to (xi), wherein method steps (i) to (iv), including a subsequent winding up of the substrate, are carried out by the first machine which is constructed as a paper machine or coating machine, while method steps (v) to (xi), including preceding unwinding of the substrate with applied third coating composition, are carried out by the second machine which is constructed as a coating machine with integrated printing unit. Of course, further method steps are conceivably implemented in both machines.

It is equally conceivable and indeed preferable when method steps (i) to (vii) are carried out in a first machine, including a subsequent winding up of the substrate, by the first machine which is constructed as a paper machine or coating machine, while method steps (viii) to (xi), including a preceding unwinding of the substrate with applied coating composition, are carried out by the second machine. Of course, further method steps are conceivably implemented in both machines.

An aspect of the method which is essential to the invention is the application of the second coating composition to the previously applied and dried heat-sensitive recording layer as the protective layer covering this heat-sensitive recording layer as well as to the back side of the substrate. This type of application of the second coating composition is implemented for forming the protective layer and for forming the backcoat, in each instance or for only one of the two cases, i.e., the protective layer or back-side printing, preferably by analog printing. By analog printing is meant within the meaning of the present invention all printing methods working with printing plate or printing cylinder, including gravure, screen printing, offset printing and, in a particularly preferred embodiment, flexographic printing. Preferably, the protective layer in method step (viii) and the coating of the back side in method step (x) are applied and printed, respectively, in the course of exactly one machine pass.

In a preferred embodiment, the second coating composition is applied and printed on, respectively, (a) for forming the protective layer covering the heat-sensitive recording layer and/or (b) for forming the coating arranged on the back side of the substrate in at least two layers arranged one on top of the other because a particularly dense and simultaneously optimally thin application can be ensured in this way.

The second coating composition in the embodiment for forming the protective layer covering the heat-sensitive recording layer and/or for forming the coating arranged on the back side of the substrate is preferably applied in each instance with an application layer having a basis weight in a range from 0.5 to 4.5 g/m$^2$. When two layers are arranged one on top of the other, the basis weight of the entire protective layer and/or backcoat is preferably in a range from 1.2 to 6 g/m$^2$ and particularly 1.5 and 4 g/m$^2$.

UV radiation and electron radiation in particular may be used as high-energy radiation for crosslinking the second coating composition for forming the protective layer covering the heat-sensitive recording layer and/or for forming the coating arranged on the back side of the substrate. UV radiation is particularly preferred. In this case, the second coating composition contains photoinitiators in a range of from 2 to 20% by weight so that the second coating composition in this particularly preferred embodiment form at least comprises:

from 65 to 95% by weight of one or more (meth)acrylates selected from the group comprising polyether(meth)acrylate, epoxy(meth)acrylate and urethane(meth)acrylate from 0 to 20% by weight of photoinitiators and from 0.5 to 20% by weight of wax, wherein the percentages by weight add up to from 67.5 to 100% by weight of the second coating composition.

The first coating composition for forming the heat-sensitive recording layer is preferably applied in method step (v) by means of a coating method selected from the list comprising roll doctor coating units, knife coating units, curtain coaters, or air brushes. The first coating composition used for forming the recording layer is preferably aqueous. The subsequent drying of the coating compound in method step (vi) is usually carried out by a method in which heat is supplied such as by hot air floatation dryers or contact dryers. A combination of the above-mentioned drying methods has also proven successful. The basis weight of the heat-sensitive recording layer is preferably between 2 g/m$^2$ and 6 g/m$^2$ or, better still, between 2.2 g/m$^2$ and 4.8 g/m$^2$.

The third coating composition for forming the pigmented intermediate layer on the front side of the substrate is preferably applied in the optional method step (ii) by means of a leveling coating process selected from the list comprising roll coating units, coating blade units, or (roll) doctor coating units. In just such a process using one of the coating processes mentioned above, the intermediate layer can contribute in a positive manner to leveling the surface of the substrate so that the amount of first coating composition to be applied for forming the heat-sensitive recording layer is reduced. The subsequent drying of the coating compound in the optional method step (iii) is usually carried out by a method in which heat is supplied such as by hot air floatation dryers or contact dryers. A combination of the above-mentioned drying methods has also proven successful. A preferred range of between 5 g/m$^2$ and 20 g/m$^2$ or, more preferably, between 7 g/m$^2$ and 12 g/m$^2$ for the basis weight of the intermediate layer has proven successful.

In preferred embodiments, the proposed method for producing a heat-sensitive recording material provides in the optional method step (iv) for smoothing the substrate with the applied and dried third coating composition and in optional method step (vii) smoothing the substrate with the optionally applied, dried third coating composition and the applied, dried first coating composition. The aim of a smoothing step of this type, which can be carried out in both instances by a calendering unit, is to create a flatter, possibly glossy surface so that text images applied to the printed-on protective layer and/or to the printed-on backcoat appear more color-intensive and vivid. Further, by improving contact with the thermal head, a smoother surface of the heat-sensitive recording layer reinforces the heat transfer and accordingly the sensitivity of this heat-sensitive recording layer.

Although the substrate is not limited to paper, paper and in this case especially a coating base paper that has not been surface-treated is the most commercially accepted substrate, also as regards good environmental soundness due to favorable recyclability, and is preferred within the framework of the invention. By a coating base paper that has not been surface-treated is meant a coating base paper that has not been treated in a size press or in a coating apparatus. Sheets, for example, of polyolefin and polyolefin-coated papers are equally possible as the substrate for the invention, without this embodiment being limiting.

Apart from the disclosed methods in all of their different, complementary embodiments, the present invention for the production of a heat-sensitive recording material is also directed to the use of a heat-sensitive recording material produced by one of these methods for parking receipts and/or parking tickets. Numerous experiments and series of tests of heat-sensitive recording materials which were produced according to one of the methods disclosed herein showed their superior effect when used as parking receipts and/or parking tickets. Particularly the problems described in the introductory part of the specification relating to severe background darkening due to direct sunlight and to jamming and sticking due to the effect of moisture could be considered as convincingly solved by the heat-sensitive recording materials which were produced according to one of the methods disclosed herein. At the same time, the method in all of its different, complementary embodiments ensures reasonable production costs. Particularly helpful in this regard are the flexible combinations of coating ink applications and duplex print applications in conjunction with components that are perfectly adapted to one another in the first, second and, optionally, third coating composition.

The data given in the description and patent claims respecting basis weight, percent by weight and parts by weight relate in each instance to dry weight ("atro"-weight), i.e., absolutely dry parts by weight. The numerical details in the statements relating to the organic pigments of the pigment-containing intermediate layer are calculated from the air-dry weight ("lutro"-weight), less the content by weight of water around and inside the pigments in the form as delivered.

The invention will be explained further with references to the following example according to the invention:

To form a paper web as substrate for a heat-sensitive recording material, a paper pulp comprising eucalyptus pulp and other wood pulp fibers is put in a blend chest together with filler and water. Additional constituents of the pulp include resin size for stock sizing in quantities of 0.6% by weight (absolutely dry) based on the total weight of the pulp and additional common additives such as, e.g., pigments and/or optical brighteners. The finished pulp is then fed to a Fourdrinier paper machine in which it is processed to form a paper web with a basis weight of 69 g/m$^2$.

After light calendering, the paper web is fed in method step (i) to a roll doctor coating unit which is integrated in the paper machine and where a pigmented intermediate layer with a basis weight of 9 g/m$^2$ is applied to the front of the paper web in method step (ii). The third coating composition used for this purpose to form the intermediate layer has

- a pigment mixture of hollow pigment and calcined kaolin with a ratio of hollow pigment to calcined kaolin of 1:4 based on percent by weight,
- styrene-butadiene latex as binder,
- starch as co-binder,
- and additional auxiliaries.

While still in the paper machine, the paper web is dried by radiant heaters and in contact with heated rolls in method step (iii), calendered in a multi-roll calender stack in method step (iv) and subsequently wound onto a tambour as semi-finished paper.

The semi-finished paper reel produced in this way is supplied to a coating machine with integrated printing units and UV emitters, where the paper web is continuously wound off again initially to a roll doctor coating device, where the prepared first coating composition is applied in method step (v) to form the heat-sensitive recording layer arranged on the front side of the substrate with a basis weight of 4.2 g/m$^2$. The following components are used for the first coating composition:

- color former: 3-dibutylamino-6-methyl-7-anilinofluoran, i.e., ODB-2;
- color acceptor: 4,4'-dihydroxydiphenyl sulfone, i.e., 4,4 BPS;
- sensitizer: dimethyl terephtalate, i.e. DMT;
- binder: ethylene vinyl alcohol copolymer, i.e., EVOH;
- additive: release agent (zinc stearate), wax, crosslinking agent The heat-sensitive recording layer is dried by hot air floatation dryers and in contact with heated rolls in method step (vi) and is calendered in a multi-roll calender stack in method step (vii). In method step (viii) the prepared second coating composition for forming the protective layer covering the heat-sensitive recording layer and directly thereafter in method step (x) the same coating composition for forming the coating arranged on the back side of the substrate is printed on in each instance by means of a multi-color flexographic printing unit in the utilized coating machine with a basis weight of 2.0 g/m$^2$. The second coating composition which is used in both cases is prepared in the following manner:

40% by weight of dipentaerythritol pentaacrylate are mixed together with 40% by weight of low-viscosity amine modified polyether acrylate and a combination of 10% by weight of benzophenone derivative and 8.5% by weight of hydroxycyclohexyl phenyl ketone. 1.5% by weight of PTFE modified polyethylene wax are added to this mixture and homogeneously mixed. This results in a composition without reactive thinners and with low residual acrylic acid.

Subsequently in method steps (ix) and (xi) which are carried out in conjunction, the two previously printed coatings are crosslinked by UV radiation on the one hand to form the protective layer covering the heat-sensitive recording layer and, on the other hand, to form the coating arranged on the back side of the substrate. Finally, the resulting finished heat-sensitive recording material is wound up and, after processing, is ready for use as a parking receipt and/or parking ticket.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A method for producing a heat-sensitive recording material with a substrate having a front side and a back side located opposite to the front side, with a heat-sensitive recording layer disposed on the front side of the substrate and containing color formers and color acceptors, with a protective layer covering the heat-sensitive recording layer, and with a coating arranged on the back side of the substrate, the method comprising at least the following steps:

preparing a first coating composition, wherein the first coating composition comprises:

a color former and as color acceptor at least 85% by weight of 4,4'-dihydroxydiphenyl sulfone based on the total percentage of color acceptors in the first coating composition, at least one sensitizer selected from the group comprising methylolstearamide, stearic acid amide, and dimethyl terephthalate;

preparing a second coating composition, wherein the second coating composition comprises:

from 65 to 95% by weight of one or more (meth)acrylates selected from the group comprising polyether (meth) acrylate, epoxy (meth)acrylate and urethane (meth) acrylate, from 0 to 20% by weight of photoinitiators and from 0.5 to 20% by weight of wax, wherein the indicated weight percent add up to from 65.5 to 100% by weight of the second coating composition;

continuously supplying the web-shaped substrate;

applying the prepared first coating composition to form the heat-sensitive recording layer arranged on the front side of the substrate;

drying the first coating composition;

applying the prepared second coating composition to form the protective layer covering the heat-sensitive recording layer;

crosslinking the protective layer covering the heat-sensitive recording layer by high-energy radiation;

applying the prepared second coating composition to form the coating arranged on the back side of the substrate; and crosslinking the coating arranged on the back side of the substrate by high-energy radiation.

2. The method for producing a heat-sensitive recording material according to claim 1, wherein 4,4'-dihydroxydiphenyl sulfone is the only color acceptor in the first coating composition.

3. The method for producing a heat-sensitive recording material according to claim 1, wherein the color formers of the first coating composition are selected from the group comprising: 3-diethylamino-6-methyl-7-anilinofluoran, 3-dibutylamino-6-methyl-7-anilinofluoran, 3-(N-methyl-N-propyl)amino-6-methyl-7-anilinofluoran, 3-(N-ethyl-N-isoamyl)amino-6-methyl-7-anilinofluoran, 3-(N-methyl-N-cyclohexyl)amino-6-methyl-7-anilinofluoran, 3-(N-ethyl-N-tolyl)amino-6-methyl-7-anilinofluoran, and 3-(N-ethyl-N-tetrahydrofuryl)amino-6-methyl-7-anilinofluoran.

4. The method for producing a heat-sensitive recording material according to claim 1, wherein a ratio of 4,4'-dihydroxydiphenyl sulfone : sensitizer based on percent by weight in the first coating composition is in a range of from 1:0.5 to 1:2.

5. The method for producing a heat-sensitive recording material according to claim 1, wherein the method comprises at least three additional steps:

preparing a third coating composition, wherein the third coating composition comprises organic pigments and inorganic pigments, which inorganic pigments are selected from the group comprising calcined kaolin, silicon oxide, bentonite, calcium carbonate and aluminum oxide, in this case in particular, boehmite;

applying the prepared third coating composition to form the pigmented intermediate layer on the front side of the substrate; and drying the third coating composition;

wherein the at least three additional method steps are to be performed before the method step of applying the prepared first coating composition for forming the heat-sensitive recording layer arranged on the front side of the substrate.

6. The method for producing a heat-sensitive recording material according to claim 5, wherein the third coating composition for forming the pigmented intermediate layer on the front side of the substrate is applied by a coating method selected from the group comprising roll coating units, coating blade units, and doctor coating units.

7. The method for producing a heat-sensitive recording material according to claim 1, wherein the second coating composition for forming the protective layer covering the heat-sensitive recording layer is applied by analog printing.

8. The method for producing a heat-sensitive recording material according to claim 1, wherein the second coating composition for forming the coating arranged on the back side of the substrate is applied by analog printing.

9. The method for producing a heat-sensitive recording material according to claim 8, wherein the application of the second coating composition (a) for forming the protective layer covering the heat-sensitive recording layer and (b) for forming the coating arranged on the back side of the substrate is carried out in the course of exactly one machine pass.

10. The method for producing a heat-sensitive recording material according to claim 1, wherein the high-energy radiation for crosslinking the second coating composition for one of (a) forming the protective layer covering the heat-sensitive recording layer and (b) forming the coating arranged on the back side of the substrate is UV radiation.

11. The method for producing a heat-sensitive recording material according to claim 1, wherein the second coating composition for one of (a) forming the protective layer covering the heat-sensitive recording layer and (b) forming the coating arranged on the back side of the substrate is applied in at least two layers arranged one above the other.

12. The method for producing a heat-sensitive recording material according to claim 1, wherein the first coating composition for forming the heat-sensitive recording layer is applied by a coating method selected from the group comprising roll doctor coating units, knife coating units, curtain coaters, and air brushes.

13. The method for producing a heat-sensitive recording material according to claim 1, wherein the drying one of (a) the first coating compound for forming the heat-sensitive recording layer and (b) the third coating composition for forming the pigmented intermediate layer is carried out by supplying heat.

14. The method for producing a heat-sensitive recording material according to claim 1, wherein the substrate is paper.

15. A parking receipt produced according to the method of claim 1.

16. A parking ticket produced according to the method of claim 1.

* * * * *